US005535794A

United States Patent [19]

Posly

[11] Patent Number: 5,535,794

[45] Date of Patent: Jul. 16, 1996

[54] WATER BOTTLE CLOSURE

[76] Inventor: Louis M. Posly, 243 Lidy Rd., Dupont, Pa. 18641

[21] Appl. No.: 328,495

[22] Filed: Oct. 25, 1994

Related U.S. Application Data

[60] Continuation-in-part of Ser. No. 224,815, Apr. 8, 1994, abandoned, which is a division of Ser. No. 133,805, Oct. 7, 1993, Pat. No. 5,379,814.

[51] Int. Cl.[6] ..... B65B 1/04; B65B 3/00

[52] U.S. Cl. ..... 141/351; 141/356; 141/366; 141/386; 222/514

[58] Field of Search ..... 141/351–357, 141/360, 362, 364–366, 386–388, 98, 106; 220/348, 262, 281; 222/185, 514, 501, 518; 251/349, 352, 353, 354, 325, 340

[56] References Cited

U.S. PATENT DOCUMENTS

| | | | |
|---|---|---|---|
| 996,127 | 6/1911 | Patnaude | 141/353 |
| 1,946,314 | 2/1934 | Desmond | 141/356 |
| 2,585,381 | 2/1952 | Gronemeyer et al. | 222/514 |
| 2,593,634 | 4/1952 | Vosburg | 222/514 |
| 2,841,175 | 7/1958 | Ford | 251/340 |
| 4,025,048 | 5/1977 | Tibbitts | 251/340 |
| 4,924,921 | 5/1990 | Simmel et al. | 141/354 |
| 4,982,881 | 1/1991 | Amrein | 141/351 |

*Primary Examiner*—Henry J. Recla
*Assistant Examiner*—Steven O. Douglas
*Attorney, Agent, or Firm*—Kane, Dalsimer, Sullivan, Kurucz, Levy, Eisele and Richard

[57] ABSTRACT

A closure on a bottle is adapted to be activated by surfaces of a cooler well to move a plunger from a closed position to a position at which water is adapted to flow out of the bottle. Selected tolerances of the plunger and sleeve in which it moves provide a seal at the closed position and prevent the plunger from being fully withdrawn from the sleeve.

9 Claims, 5 Drawing Sheets

WATER BOTTLE CLOSURE

REFERENCE TO RELATED APPLICATIONS

This application is a continuation-in-part of application Ser. No. 08/224,815 filed Apr. 8, 1994, now abandoned, which is a division of application Ser. No. 08/133,805 filed Oct. 7, 1993 now U.S. Pat. No. 5,379,814 granted Jan. 10, 1995.

BACKGROUND OF THE INVENTION

Many offices and establishments offer bottled water to their employees and patrons. Water bottles are normally associated with a water cooler for dispensing and are initially sealed with a cap which is removed in order that the bottle may be lifted and inverted to be placed neck down into the receiving well of the cooler. These bottles whether of plastic or glass when full of water, are heavy so that the typical female and some males simply cannot perform the task of lifting and inverting the water bottle and then lower it into the well of the cooler. Reference is made to the above referenced patent applications for a lifting mechanism for water bottles.

SUMMARY OF THE INVENTION

It is a principal object of the present invention to provide an improved closure for receptacles and bottles in general and specifically, for a water bottle, which will maintain the bottle opening closed and sealed during bottle lifting, inverting and lowering and when placed on the well of the cooler, cooperate with surfaces of the cooler to open to permit the water in the bottle to be accessed for dispensing from the cooler.

Other objects and advantages will become apparent from the following detailed description which is to be taken in conjunction with the accompanying drawings.

DETAILED DESCRIPTION OF THE PREFERRED EMBODIMENTS

Figure 1:
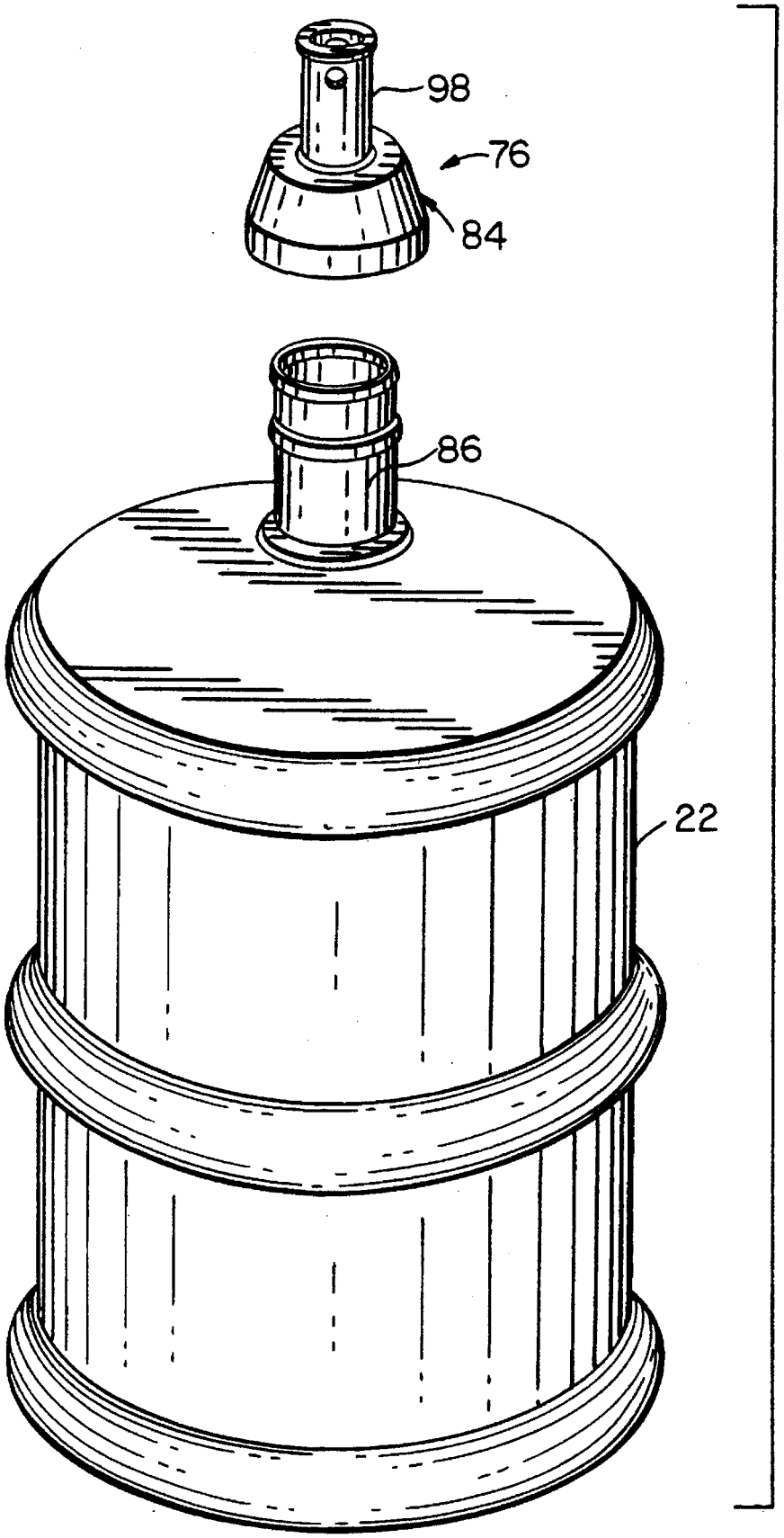
FIG. 1 is an enlarged exploded perspective view of a water bottle and closure of this invention.
Figure 2:
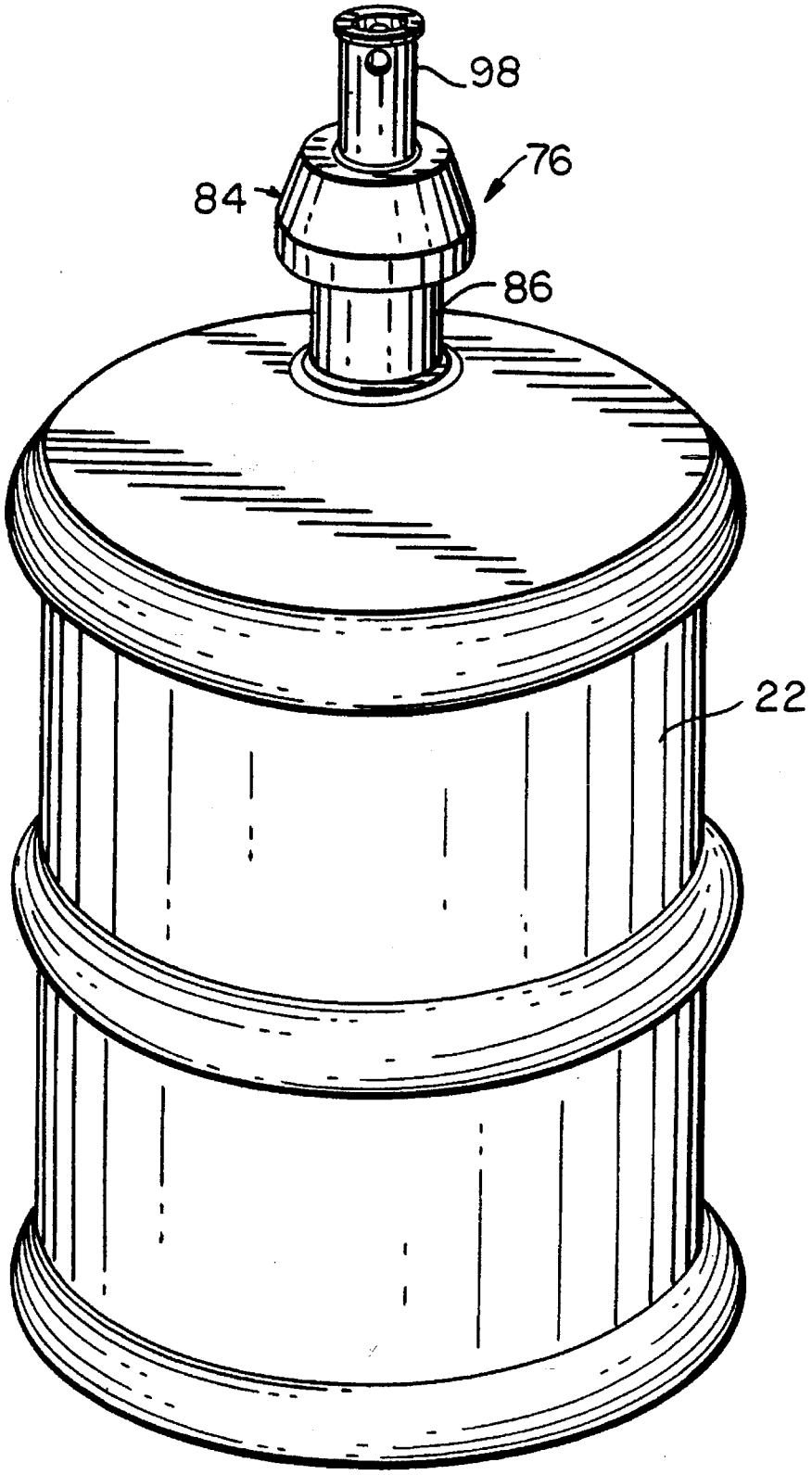
FIG. 2 is a similar perspective view with the closure coupled across the mouth of the neck of the bottle
Figure 3:
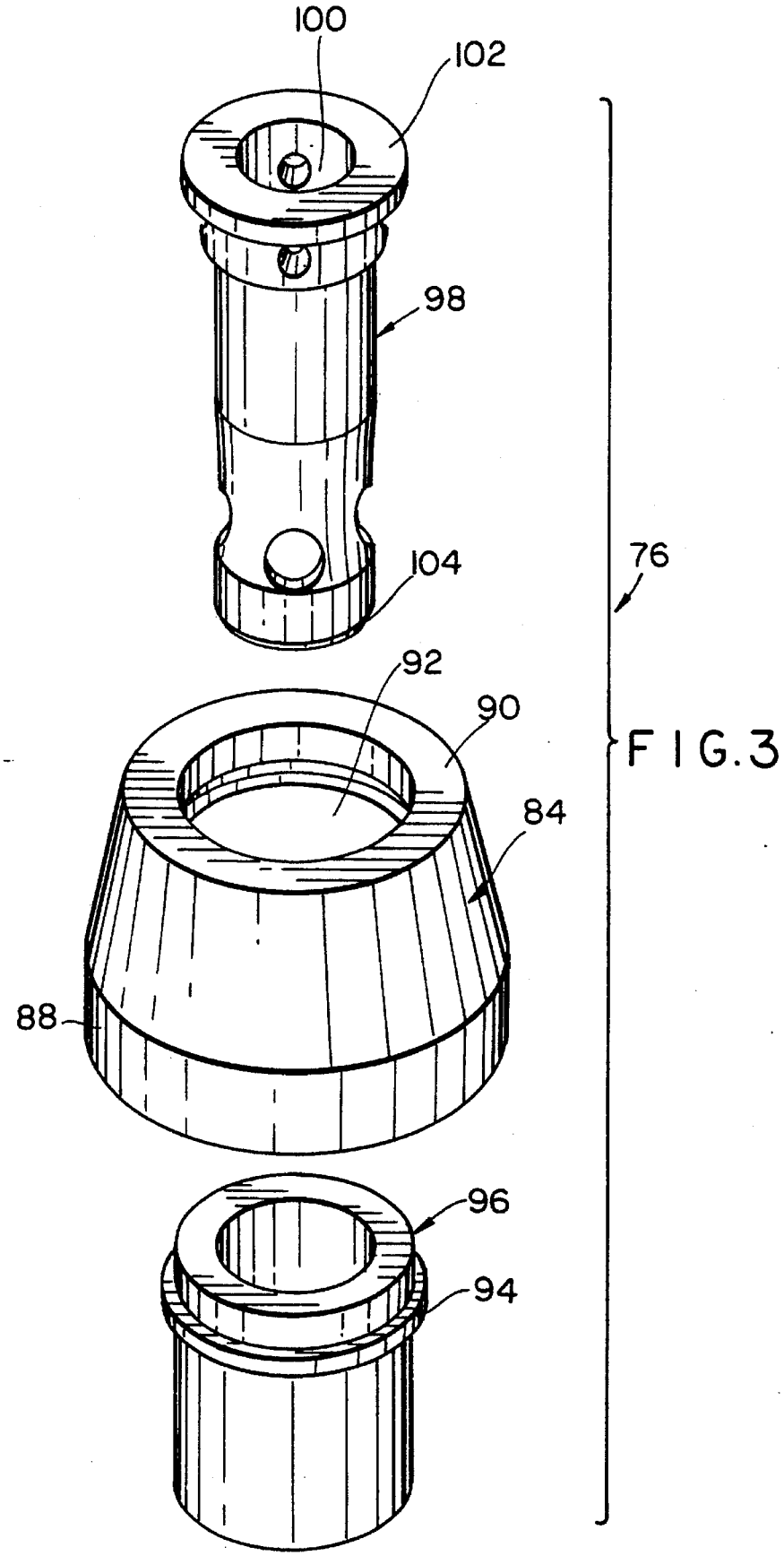
FIG. 3 is an enlarged, exploded perspective view of the closure of the invention.
Figure 4:
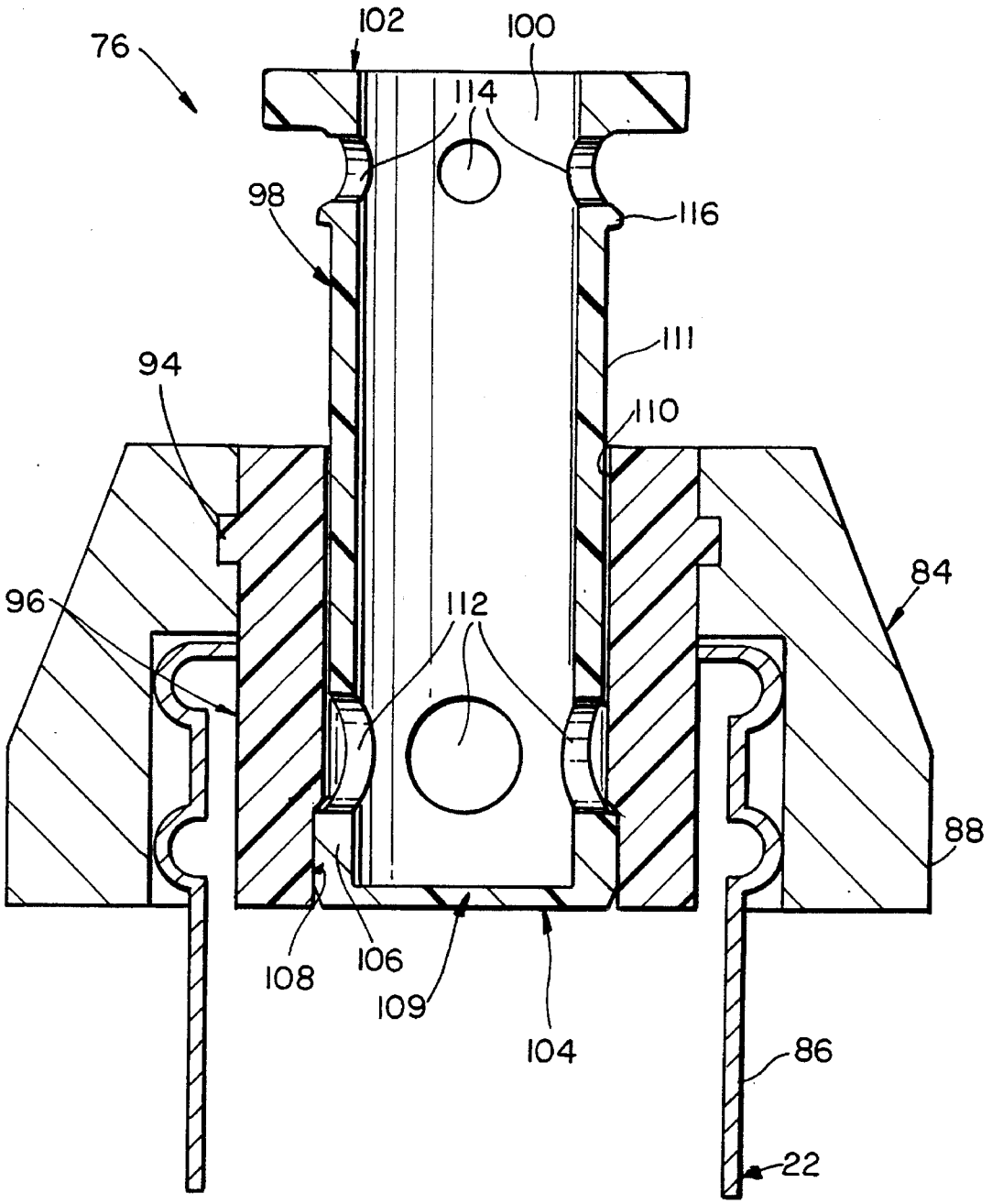
FIG. 4 is an enlarged longitudinal sectional view of the assembled closure shown associated with the neck of a water bottle with the closure in its closed sealed position.
Figure 5:
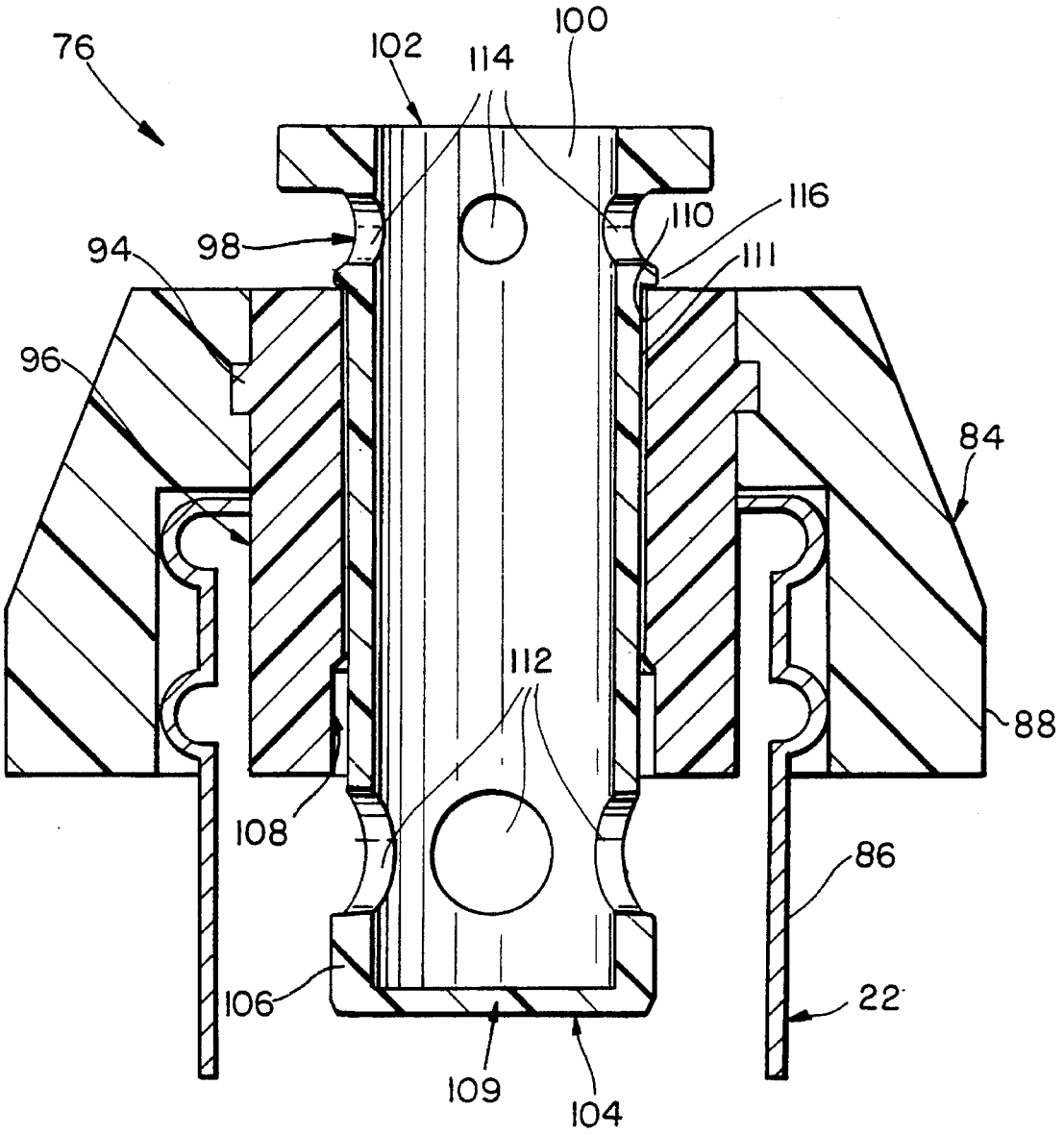
FIG. 5 is a similar longitudinal sectional view of the closure in its opened position for dispensing.

In the drawings, the closure 76 includes a cap 84 of neoprene rubber or other elastomer possessing good sealing properties which is adapted to be tightly placed over the neck 86 of bottle 22. The cap 84 includes a downwardly depending cylindrical skirt 88 and an upper inwardly extending flange 90 that has a annular recess 92 that receives flange 94 of inner cylindrical sleeve 96. Skirt 88 and flange 90 cooperate in tightly engaging and sealing the neck 86 of bottle 22. The sleeve 96 slidably receives plunger 98 that has an axial bore 100 and is open at its flanged top 102 and closed at its bottom or inner end 104. The sleeve 96 and plunger 98 may be suitably molded of plastic such as polyethylene. The lower inner end 104 of the plunger 98 includes a section 106 having an outer diameter approximately equal to the inner diameter of the inner bore 108 to provide a seal therewith and cooperate to close off the liquid within the bottle 22 when the bottle 22 is turned upside down to its inverted position. In order to prevent inadvertent withdrawal of the plunger 98 from the sleeve 96 once inserted, lead bore 110 communicating with bore 108 will be reduced in diameter to render it extremely difficult for section 106 to pass through reduced bore 110. The resiliency of the plastic of sleeve 96 and plunger 98 however permits the initial insertion of the plunger 98 into the sleeve 96. Towards that end, the leading end 109 of the plunger is beveled to facilitate entry of the plunger 98 into sleeve 96. Moreover, the outer end of the plunger 98 has a section 111 of slightly reduced diameter which permits more easy sliding of the plunger 98 in sleeve 96 when the seal between bore 108 and plunge section 106 is broken. The bore 100 communicates with lateral ports 112 which will be sealed when the plunger 98 is in its closed position and opened to permit liquid in bottle 22 to flow into bore 100 when the plunger 98 is forced into its opened position when the bottle 22 is inverted. The upper part of plunger 98 may have lateral ports 114 to facilitate the dispensing process when the closure 76 is disposed in the well of a cooler.

The closure 76 is placed on the neck 86 of the bottle 22 when in an upright position. The plunger 98 at this time will be in its closed position which can be effected manually. During the turning of the bottle 22 either manually or by the lift mechanism of the above referenced patent applications from its upright position to its inverted position, the plunger 98 will remain in this closed position with the pressure of the water tending to force the plunger into the closed position. When the inverted bottle 22 is lowered 10 into the well of a cooler, the flanged end 102 will engage surfaces of the cooler to force the plunger 98 into the bottom neck into its open position at which the flange 116 engages the outer end of sleeve 96 at which liquid will flow through lateral ports 112 into bore 100 and out the open end 102 where possible as well as lateral ports 114.

In accordance with a successful embodiment of the present invention, section 106 had an OD of 1.258", section 111 had an OD of 1.234", bore 108 had an ID of 1.258" and the lead bore 110 an ID of 1.252". The OD of section 106 and ID of bore 108 should be at least equal in dimension for proper sealing when the plunger is in its retraced closed sealed position.

Thus, the several aforementioned objects and embodiments are most effectively attained. Although a single somewhat preferred embodiment of the invention has been described and disclosed in detail herein, it should be understood that this invention is in no sense limited thereby and its scope is to be determined by that of the appended claims.

What is claimed is:

1. A closure comprising a cap to be coupled so as to surround the neck of a bottle, an inner sleeve connected with the cap having an inner end and an outer end and adapted to be disposed within the neck of the bottle, the sleeve having an inner bore at its inner end having a predetermined diameter and a lead bore of reduced diameter with respect to the inner bore at its other end communicating with the inner bore, a slidable plunger within the sleeve and adapted to be moved from an outwardly extending closed position to an inwardly extending open position, the plunger having an axial bore and an inner closed end and an outer open end, a first outer section of the plunger at the inner closed end having an outer diameter approximately equal to the diameter of the inner bore of the sleeve, at least one lateral port at the closed end communicating with the bore, the lateral port being sealed off when the plunger is in its outwardly extending closed position at which surfaces of the first outer section of the plunger sealingly engage with surfaces of the inner bore of the sleeve, and adapted to permit liquid flow through it into the bore when the plunger is in its inwardly extending open position at which the surfaces no longer sealingly engage, a second outer section of the plunger extending from the first outer section to the open outer end having an outer diameter less than the first section and less than the inner bore of the sleeve to render the plunger more easily slidable in the sleeve when the surfaces of the inner bore of the sleeve and first section of the plunger no longer sealingly engage.

2. The invention in accordance with claim 1 wherein the cap is of an elastomeric material and is adapted to sealingly engage the neck of the bottle.

3. The invention in accordance with claim 2 wherein the cap includes a downwardly depending skirt adapted to embrace the exterior of the bottle neck and an inwardly extending flange coupled with surfaces of the inner sleeve.

4. The invention in accordance with claim 3 wherein the sleeve is cylindrical and includes a flange embracing surfaces of the flange of the cap.

5. The invention in accordance with claim 1 wherein the plunger includes an outer flange that engages with the outer end of the sleeve to limit the extent of insertion of the plunger into the sleeve and at least one lateral port at the outer open end communicating with the axial bore.

6. The invention in accordance with claim 1 wherein the inner closed end of the plunger is externally tapered to facilitate inserting the plunger into the sleeve.

7. A closure comprising a cap to be coupled so as to surround the neck of a bottle, an inner sleeve connected with the cap having an inner end and an outer end and adapted to be disposed within the neck of the bottle, the sleeve having an inner bore at its inner end having a predetermined diameter and a lead bore of reduced diameter with respect to the inner bore at its other end communicating with the inner bore, a slidable plunger within the sleeve and adapted to be moved from an outwardly extending closed position to an inwardly extending open position, the plunger having an axial bore and an inner closed end and an outer open end, a first outer section of the plunger at the inner closed end having an outer diameter approximately equal to the diameter of the inner bore of the sleeve, at least one lateral port at the closed end communicating with the bore, the lateral port being sealed off when the plunger is in its outwardly extending closed position at which surfaces of the first outer section of the plunger sealingly engage with surfaces of the inner bore of the sleeve, and adapted to permit liquid flow through it into the bore when the plunger is in its inwardly extending open position at which the surfaces no longer sealingly engage, the sleeve including a lead bore extending from and communicating with the inner bore to the outer end that is of lesser diameter than the inner bore and outer diameter of the first outer section of the plunger whereby the plunger is prevented from being fully retracted from the sleeve after the plunger is inserted into the sleeve at which the surfaces of the plunger and sleeve sealingly engage.

8. A closure comprising a cap to be coupled so as to surround the neck of a bottle, an inner sleeve connected with the cap having an inner end and an outer end and adapted to be disposed within the neck of the bottle, the sleeve having an inner bore at its inner end having a predetermined diameter and a lead bore of reduced diameter with respect to the inner bore at its other end communicating with the inner bore, a slidable plunger within the sleeve and adapted to be moved from an outwardly extending closed position to an inwardly extending open position, the plunger having an axial bore and an inner closed end and an outer open end, a first outer section of the plunger at the inner closed end having an outer diameter approximately equal to the diameter of the inner bore of the sleeve, at least one lateral port at the closed end communicating with the bore, the lateral port being sealed off when the plunger is in its outwardly extending closed position at which surfaces of the first outer section of the plunger sealingly engage with surfaces of the inner bore of the sleeve, and adapted to permit liquid flow through it into the bore when the plunger is in its inwardly extending open position at which the surfaces no longer sealingly engage, a second outer section of the plunger extending from the first outer section to the open outer end having an outer diameter less than the first section and less than the inner bore of the sleeve to render the plunger more easily slidable in the sleeve when the surfaces of the inner bore of the sleeve and first section of the plunger no longer sealingly engage, the inner closed end of the plunger being externally tapered to facilitate inserting the plunger into the sleeve, the sleeve including a lead bore extending from and communicating with the inner bore to the outer end that is of lesser diameter than the inner bore and outer diameter of the first outer section of the plunger whereby the plunger is prevented from being fully retracted from the sleeve after the plunger is inserted into the sleeve at which the surfaces of the plunger and sleeve sealingly engage.

9. The invention in accordance with claim 8 wherein the cap is of an elastomeric material and is adapted to sealingly engage the neck of the bottle, the cap includes a downwardly depending skirt adapted to embrace the exterior of the bottle neck and an inwardly extending flange coupled with surfaces of the inner sleeve, the sleeve is cylindrical and includes a flange embracing surfaces of the flange of the cap, the plunger includes an outer flange that engages with the outer end of the sleeve to limit the extent of insertion of the plunger into the sleeve and at least one lateral port at the outer open end communicating with the axial bore.

* * * * *